US012303971B2

(12) United States Patent
Liu et al.

(10) Patent No.: US 12,303,971 B2
(45) Date of Patent: May 20, 2025

(54) DEVICE AND PROCESS FOR HOT AIR JET DEWAXING AND RECLAIMING WAX COMPOSITION FROM PATTERN FOR CASTING SHELL MAKING

(71) Applicant: Inner Mongolia University of Technology, Hohhot (CN)

(72) Inventors: Chang Liu, Hohhot (CN); Xiangdong Liu, Hohhot (CN); Hua Feng, Hohhot (CN); Zhongxing Tian, Hohhot (CN); Yuecheng Zhang, Hohhot (CN)

(73) Assignee: Inner Mongolia University of Technology, Hohhot (CN)

( * ) Notice: Subject to any disclaimer, the term of this patent is extended or adjusted under 35 U.S.C. 154(b) by 0 days.

(21) Appl. No.: 18/673,595

(22) Filed: May 24, 2024

(65) Prior Publication Data

US 2024/0399443 A1 Dec. 5, 2024

(30) Foreign Application Priority Data

Jun. 1, 2023 (CN) ..... 202310642203.X

(51) Int. Cl.
*B22C 5/18* (2006.01)
*B22C 19/00* (2006.01)

(52) U.S. Cl.
CPC ..... *B22C 5/185* (2013.01); *B22C 19/00* (2013.01)

(58) Field of Classification Search
CPC ..... B22C 5/185; B22C 19/00
See application file for complete search history.

(56) References Cited

U.S. PATENT DOCUMENTS 5,372,177 A * 12/1994 Foster ..... B22C 9/043 164/35

* cited by examiner

*Primary Examiner* — Kevin P Kerns
*Assistant Examiner* — Steven S Ha
(74) *Attorney, Agent, or Firm* — Nixon Peabody LLP

(57) ABSTRACT

A device and process for hot air jet dewaxing and reclaiming wax composition from patter for investment casting shell making. The device includes a hot air supply mechanism, a hot air jet dewaxing mechanism, a liquid wax collection mechanism, a liquid wax reclaiming mechanism, and a bearing platform. A shell for investment casting is installed on the bearing platform. A hot air outlet end of the hot air supply mechanism is in fluid communication with a hot air inlet end of the hot air jet dewaxing mechanism, and an injector connected with hot air outlet end of the hot air jet dewaxing mechanism extends into a cavity of the shell and faces the body of a wax pattern. Liquid wax generated in the cavity of the shell flows under the action of self-gravity into the liquid wax collection mechanism from its liquid wax inlet end.

10 Claims, 3 Drawing Sheets

DEVICE AND PROCESS FOR HOT AIR JET DEWAXING AND RECLAIMING WAX COMPOSITION FROM PATTERN FOR CASTING SHELL MAKING

CROSS-REFERENCE TO RELATED APPLICATION

This patent application claims the benefit of and priority to Chinese Patent Application No. 202310642203.X filed with the Chinese Patent Office on Jun. 1, 2023, which is hereby incorporated by reference herein in its entirety.

TECHNICAL FIELD

The present disclosure relates to the technical field of dewaxing in investment casting shell making, and in particular to a device and process for hot air jet dewaxing and reclaiming wax composition from pattern for investment casting shell making.

BACKGROUND

Dewaxing is an extremely important procedure in the production of investment castings, which is related to the quality and performance of mold shells. In the shell-making process, shell layers with different thicknesses are constructed on a surface of the wax mold to form a mold shell with sufficient thickness and strength. Afterwards, the mission of the wax mold is completed and must be removed. The cavity formed after the removal of liquid wax is used to hold liquid metal, the liquid metal solidifies in the cavity to obtain the casting. At present, wax-based mold materials are mostly used in investment casting, which are a mixture of paraffin and stearic acid, and have the characteristics of softening and melting when heated, so the mold shell dewaxing is generally carried out by heating method.

At present, hot water bath dewaxing (for water glass mold shells) or steam dewaxing (for silica sol mold shells) is often used in mold shell dewaxing process, which is simple and efficient. However, the key problems with these two dewaxing processes are as follows: since the water or steam is used as a heat carrier, a large amount of water is contained in the melted and reclaimed mold material. During dewaxing process, the residual alkaline binder in the mold shell dissolves in water and promotes saponification reaction on the surface of the wax mold, the water mixed in the reclaimed liquid wax and flocculent saponification products lead to changes in physical and chemical properties, and should be filtered, dehydrated, and treated with acid (usually hydrochloric acid or sulfuric acid) before being reused as mold wax material. Moreover, the acid treatment process is complicated, the reclaiming and treatment cost of acid-containing waste liquid is high, and direct discharge of the waste liquid will pollute the environment. Especially when treated with hydrochloric acid, serious hydrogen chloride acid mist is produced, which worsens the operating environment and causes permanent damage to production equipment and safety facilities on site.

In addition, during the dewaxing process, a large amount of water permeates into the shell layer of the mold shell, resulting in high water content and low wet strength of the mold shell during and after dewaxing process (some partially gelled binders in the mold shell are hydrolyzed at high temperature and lose strength, and when the mold shell is seriously damaged due to this, it is commonly known as "boiled"), high reject rate, as well as slow drying of the mold shell and long shell-making period. Furthermore, the water bath dewaxing or steam dewaxing belongs to the overall heating mode of the mold shell. During the dewaxing process, because the thermal expansion coefficient of the wax mold is greater than that of the mold shell, the mismatch between the thermal expansion coefficients of the wax mold and the mold shell induces significant expansion stress, which causes the low-strength mold shell to be easily deformed or even cracked (expansion cracked), unstable quality and performance of the mold shell, and stubbornly high reject rate.

SUMMARY

To this end, the technical problem to be solved by the present disclosure is to provide a device and process for hot air jet dewaxing and reclaiming wax composition from patter for investment casting shell making, so as to solve the problems of deformation, cracking or damage caused by low wet strength of the mold shell in the existing investment casting shell water bath or steam dewaxing process, as well as the problems of high energy consumption, low efficiency, complicated process, low quality of reclaimed liquid wax, and environmental pollution caused by waste liquid treatment in the dehydration and acid treatment process in the mold material reclaiming process.

To solve the technical problems above, the present disclosure provides the following technical solution:

A device for hot air jet dewaxing and reclaiming wax composition from pattern for investment casting shell making includes a hot air supply mechanism, a hot air jet dewaxing mechanism, a liquid wax collection mechanism, a liquid wax reclaiming mechanism, and a bearing platform. A investment casting shell is fixedly installed on the bearing platform, a hot air outlet end of the hot air supply mechanism is in fluid communication with a hot air inlet end of the hot air jet dewaxing mechanism, and a hot air outlet end of the hot air jet dewaxing mechanism extends into a cavity of the investment casting shell and faces a wax pattern. Liquid wax generated in the cavity of the shell flows under the action of self-gravity into the liquid wax collection mechanism from its liquid wax inlet end, and a liquid wax outlet end of the liquid wax collection mechanism is in fluid communication with a liquid wax inlet end of the liquid wax reclaiming mechanism.

According to the device for hot air jet dewaxing and reclaiming wax composition from pattern for investment casting shell making, the hot air supply mechanism includes a hot air blower, and a gas pressure regulator. A hot air outlet end of the hot air blower is in fluid communication with a hot air inlet end of the gas pressure regulator. A pressure-regulating valve on the gas pressure regulator is controlled to regulate jet pressure of the hot air blower. A hot air outlet end of the gas pressure regulator is in fluid communication with the hot air inlet end of the hot air jet dewaxing mechanism.

According to the device for hot air jet dewaxing and reclaiming wax composition from pattern for investment casting shell making, the hot air jet dewaxing mechanism includes a gas supply pipe, a parallel mechanical claw, a universal metal pipe, a rotary spray head, and a crawler manipulator. The parallel mechanical claw is installed on the crawler manipulator, and an outer pipe wall of the gas supply pipe is clamped on the parallel mechanical claw by clamping parts of the parallel mechanical claw. The universal metal pipe is fixedly connected to the gas supply pipe, and the rotary spray head is fixedly installed at one end of the universal metal pipe. A hot air outlet end of the gas supply pipe is in fluid communication with a hot air inlet end of the universal metal pipe, and a hot air outlet end of the universal metal pipe is in fluid communication with a hot air inlet end of the rotary spray head. A hot air outlet end of the rotary spray head extends into the cavity of the investment casting shell and faces the wax mold. A hot air inlet end of the gas supply pipe is in fluid communication with the hot air outlet end of the hot air supply mechanism through a flexible pipe.

According to the device for hot air jet dewaxing and reclaiming wax composition from pattern for investment casting shell making, the gas supply pipe is a stainless-steel straight pipe. The parallel mechanical claw is a four-degree-of-freedom parallel mechanical claw. The universal metal pipe is a flexible and pressure-resistant universal metal pipe. The rotary spray head is a 360-degree automatic rotary porous spray head. The flexible pipe is a high-temperature-resistant and pressure-resistant flexible pipe.

According to the device for hot air jet dewaxing and reclaiming wax composition from pattern for investment casting shell making, the liquid wax collection mechanism is a liquid collection tank, the liquid collection tank includes a wax droplet converging tank and an axial cavity, the wax droplet converging tank is used to converge melted and scattered wax droplets (or dispersed small liquid wax flow) in the tank, and the axial cavity provides a channel for the spray head to enter an inner cavity of the mold shell; the melted liquid wax drops down in droplets or flows out in multiple small liquid streams, which can be easily scattered and cooled rapidly, resulting in a decrease in fluidity. Therefore, in order to prevent rapid cooling, it is an effective means to quickly converge the wax droplets into large liquid streams by means of the wax droplet converging tank. The wax droplet converging tank and the axial cavity are two mutually independent spaces. The rotary spray head and the universal metal pipe connected to the rotary spray head sequentially pass through the axial cavity and extend into the cavity of the investment casting shell. Distance between the rotary spray head and the surface of the wax mold, and dewaxing rate can be adjusted by controlling longitudinal displacement (lifting) rate of the gas supply pipe clamped by the parallel mechanical claw, the gas supply pipe extends into the axial cavity, a one-way flow-stop rubber ring is sleeved on the outer pipe wall of the gas supply pipe, the one-way flow-stop rubber ring is in sealing fit with an inner wall of the axial cavity to prevent the wax droplets from leaking or flowing along the outer wall of the gas supply pipe. A liquid wax outlet end of the liquid collection tank is in fluid communication with a liquid wax inlet end of the liquid wax reclaiming mechanism. The liquid wax produced in the cavity of the investment casting shell flows into the wax droplet converging tank of the liquid collection tank under gravity. The liquid collection tank is fixedly installed on the bearing platform.

According to the device for hot air jet dewaxing and reclaiming wax composition from pattern for investment casting shell making, the liquid collection tank is one or a combination of two or more of inverted regular quadrangular frustum, inverted circular truncated cone, trapezoidal frustum, cube or cuboid. A wax discharge hole is arranged at a bottom of the wax droplet converging tank.

According to the device for hot air jet dewaxing and reclaiming wax composition from pattern for investment casting shell making, the liquid wax reclaiming mechanism includes filtering equipment, a wax storage barrel, and an oil bath. The filtering equipment is installed at an upper part of the wax storage barrel in a movably embedded manner, and the wax storage barrel is installed in a heating medium of the oil bath. A liquid wax outlet end of the filtering equipment is in fluid communication with a liquid wax inlet end of the wax storage barrel, and a liquid wax inlet end of the filtering equipment is in fluid communication with the liquid wax outlet end of the liquid wax collection mechanism.

A thermal insulation cover is further arranged on the wax storage barrel. When the liquid wax stored in the wax storage barrel reaches a specified capacity, the filtering equipment arranged at the upper part of the liquid storage barrel in a movably embedded manner is removed, and then the thermal insulation cover is closed to cover the wax storage barrel and achieve heat preservation and storage of the reclaimed liquid wax. An open-close lifting ring for manual or mechanical opening and closing of the thermal insulation cover is arranged on the thermal insulation cover. The liquid wax flows into the wax storage barrel of the liquid wax reclaiming mechanism through holes of first-stage and second-stage filter screens of the filtering equipment in sequence by self-gravity.

According to the device for hot air jet dewaxing and reclaiming wax composition from pattern for investment casting shell making, the filtering equipment is of a double-layer filter screen structure, the liquid wax collected from the liquid collection tank flows into the filtering equipment under gravity, and the filtered liquid wax vertically falls into the wax storage barrel in droplets or liquid streams. The filtering equipment includes a first-stage filter screen, a second-stage filter screen, and a filter screen bracket. The first-stage filter screen is fixedly installed at a top of the filter screen bracket, and the second-stage filter screen is fixedly installed at a bottom of the filter screen bracket. The filter screen bracket is installed at the upper part of the wax storage barrel in a movably embedded manner (the filter screen bracket is directly inserted into the upper port of the wax storage barrel). A liquid wax outlet end of the first-stage filter screen is in fluid communication with a liquid wax inlet end of the second-stage filter screen, and a liquid wax outlet end of the second-stage filter screen is in fluid communication with a liquid wax inlet end of the wax storage barrel. A liquid wax inlet end of the first-stage filter screen is in fluid communication with the liquid wax outlet end of the liquid wax collection mechanism via a through hole.

According to the device for hot air jet dewaxing and reclaiming wax composition from pattern for investment casting shell making, a filter medium in the first-stage filter screen is a 60-mesh stainless steel filter screen, and a filter medium in the second-stage filter screen is a 200-mesh stainless steel filter screen.

In the present disclosure, working pressure of the gas pressure regulator is in a range of 0~2.0 MPa, maximum working temperature is not lower than 200° C., and indication range of a gas outlet pressure gauge is 0~0.9 MPa. Pipe diameter of each of the hot air inlet end and the hot air outlet end is DN8. The pressure is adjusted by rotating a pressure-regulating nut. The crawler manipulator is a crawler robot chassis with a Christie suspension system, capable of steering in situ, with running speed of 0-1.4 m/s and maximum load of 80 kg. The manipulator is a vertical multi-joint arm with six degrees of freedom, with maximum load of 10 kg, and maximum stroke as follows: the arm is rotated by +/−180°, swung back and forth by +155°~−105°, and swung up and down by +150°~−163°, and the wrist is rotated by +/−270°, bent by +/−145° and twisted by +/−360°, and maximum synthetic speed is 13,100 mm/s.

A process for hot air jet dewaxing and reclaiming wax composition from pattern for investment casting shell making is provided, wherein the above device for hot air jet dewaxing and reclaiming wax composition from pattern for investment casting shell making is used for the hot air jet dewaxing and reclaiming wax composition from pattern for investment casting shell making, the process includes the following steps:

Step A: according to dewaxing process requirements determined by material and structure of the wax mold for investment casting shell making, adjusting temperature and jet pressure of hot air through the hot air supply mechanism;

Step B: according to the dewaxing process requirements determined by the material and structure of the wax mold for investment casting shell making, adjusting jet direction and the jet pressure of the hot air through the hot air jet dewaxing mechanism to drive the hot air outlet end of the hot air jet dewaxing mechanism to rotate in different rotation rates, so as to control asynchronous melting loss rate of different micro-regions of the wax mold in the investment casting shell, and make different regions of the wax mold melted asynchronously;

Step C: collecting liquid wax obtained by melting in Step B through the liquid wax collection mechanism; and Step D: filtering, heating, and recycling the liquid wax collected in Step C through the liquid wax reclaiming mechanism.

The technical solution in the present disclosure achieves the following beneficial effects:

1. According to the device for hot air jet dewaxing and reclaiming wax composition from pattern for investment casting shell making, dry air is used as a heat carrier, which eliminates the adverse effects of the water-containing medium on the strength of the mold shell and the physical and chemical properties of the reclaimed liquid wax during dewaxing. The reclaimed liquid wax does not need to be acidified, and thus the process is simplified. The acid-containing waste liquid is not produced, and nearly zero emission is helpful to achieve clean production.

2. According to the device for hot air jet dewaxing and reclaiming wax composition from pattern for investment casting shell making, the high-pressure hot airflow is used to impact a local region of the wax mold, and the precise control of melting loss rate of the wax mold is achieved through different combinations of parameters such as airflow temperature, jet pressure, as well as size and shape of the spray head. Different micro-regions of the wax mold are melted asynchronously, leading to low expansion stress. Therefore, the mold shell is small in deformation and cracking tendency, high in dimensional accuracy, and low in reject rate. In addition, in the process of high-pressure hot airflow impact dewaxing, the residual binder in the mold shell that is partially hardened continues to be dehydrated under the high-temperature airflow, which improves the wet strength of the mold shell and the ability of the mold shell to resist deformation and cracking.

3. According to the device for hot air jet dewaxing and reclaiming wax composition from pattern for investment casting shell making, the four-degree-of-freedom parallel mechanical claw is used to control the attitude adjustment and movement of the straight stainless steel gas supply pipe, which can achieve the axial displacement and small lateral displacement of the hot airflow in the mold cavity, and is suitable for dewaxing the mold shell with a complex inner cavity structure. The spray head that is capable of rotating 360° is adopted, and the airflow is sprayed from the non-axisymmetric outlet to produce a torque that drives the spray head to rotate, and the hot airflow has thermal impact and cutting effect on the wax mold, which ensures that the heated area of the wax mold is evenly heated in a radial direction and is beneficial to reducing the temperature difference stress. A universal flexible pressure-resistant metal pipe is connected to the airflow spray head, thus reducing the impact and damage to the inner cavity surface of the mold shell during the movement of the spray head.

4. According to the device for hot air jet dewaxing and reclaiming wax composition from pattern for investment casting shell making, the spray head is of various structures and forms, is detachable, and is convenient for replacement according to the structure and characteristics of the inner cavity of the mold shell and the requirement of dewaxing rate. A stainless-steel conduit is used as a rigid straight gas guide pipe, and the length of the gas guide pipe can be adjusted by connecting multiple stainless-steel conduits through threads according to the depth or width of the inner cavity of the mold shell. An opening at an upper end of the liquid collection tank is gradually widened, which can be suitable for pouring cups or wax discharge ports with different sizes.

5. According to the simple and feasible device for hot air jet dewaxing and reclaiming wax composition from pattern for investment casting shell making, the dewaxing process is simplified, the wet strength of the mold shell is improved, and the deformation and cracking of the mold shell during dewaxing is reduced. The reclaimed liquid wax is free of water and has stable physical and chemical properties. The filtering by the double filter screen leads to high cleanliness. The production efficiency of dewaxing is high, the cost and labor intensity of shell making are low, and zero emission of pollutants is realized.

Figure 1:
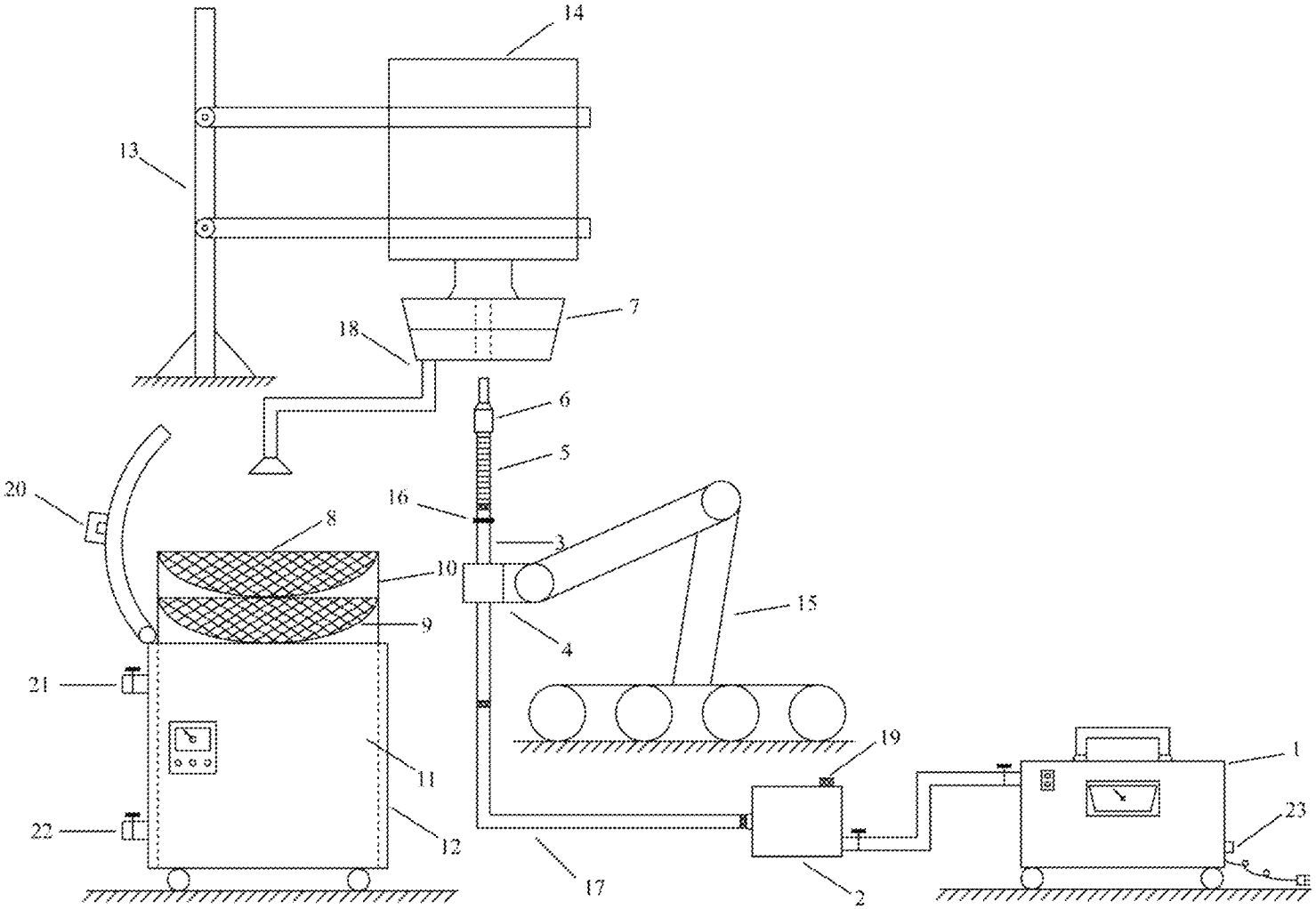
FIG. 1 is a schematic diagram of a structure of a device and process for hot air jet dewaxing and reclaiming wax composition from pattern for investment casting shell making according to an embodiment of the present disclosure.

In the drawings: 1 hot air blower; 2 gas pressure regulator; 3 gas supply pipe; 4 parallel mechanical claw; 5 universal metal pipe; 6 rotary spray head; 7 liquid collection tank; 8 first-stage filter screen; 9 second-stage filter screen; 10 filter screen bracket; 11 wax storage barrel; 12 oil bath; 13 bearing platform; 14 investment casting shell; 15 crawler manipulator; 16 one-way flow-stop rubber ring; 17 flexible pipe; 18 wax discharge hole; 19 pressure-regulating valve; 20 thermal insulation cover; 21 heating oil outlet; 22 heating oil inlet; 23 air inlet port; 24 axial cavity; 25 wax droplet converging tank.

DETAILED DESCRIPTION OF THE EMBODIMENTS

In this embodiment, a device for hot air jet dewaxing and reclaiming wax composition from pattern for investment casting shell making includes a hot air supply mechanism, a hot air jet dewaxing mechanism, a liquid wax collection mechanism, a liquid wax reclaiming mechanism, and a bearing platform 13. A investment casting shell 14 is fixedly installed on the bearing platform 13, as shown in FIG. 1.

The hot air supply mechanism includes a hot air blower 1, and a gas pressure regulator 2. The hot air jet dewaxing mechanism includes a gas supply pipe 3, a parallel mechanical claw 4, a universal metal pipe 5, a rotary spray head 6, and a crawler manipulator 15. The liquid wax collection mechanism is a liquid collection tank 7. The liquid wax reclaiming mechanism includes filtering equipment, a wax storage barrel 11, and an oil bath 12. The filtering equipment includes a first-stage filter screen 8, a second-stage filter screen 9, and a filter screen bracket 10.

A hot air outlet end of the hot air blower 1 is in fluid communication with a hot air inlet end of the gas pressure regulator 2. A pressure-regulating valve 19 on the gas pressure regulator 2 is controlled to regulate jet pressure of the hot air blower 1.

The parallel mechanical claw 4 is installed on the crawler manipulator 15, and an outer pipe wall of the gas supply pipe 3 is clamped on the parallel mechanical claw 4 by clamping parts of the parallel mechanical claw 4. The universal metal pipe 5 is fixedly connected to the gas supply pipe 3, and the rotary spray head 6 is fixedly installed at one end of the universal metal pipe 5. A hot air outlet end of the gas supply pipe 3 is in fluid communication with a hot air inlet end of the universal metal pipe 5, and a hot air outlet end of the universal metal pipe 5 is in fluid communication with a hot air inlet end of the rotary spray head 6. A hot air outlet end of the rotary spray head 6 extends into the cavity of the investment casting shell 14 and faces the wax mold. A hot air inlet end of the gas supply pipe 3 is in fluid communication with a hot air outlet end of the gas pressure regulator 2 through a flexible pipe 17.

The liquid collection tank 7 includes a wax droplet converging tank 25 and an axial cavity 24, and the wax droplet converging tank 25 and the axial cavity 24 are two independent spaces from each other. The rotary spray head 6 and the universal metal pipe 5 sequentially penetrate through the axial cavity 24 and extend into the cavity of the investment casting shell 14, the gas supply pipe 3 extends into the axial cavity 24, a one-way flow-stop rubber ring 16 is sleeved on the outer pipe wall of the gas supply pipe 3, and the one-way flow-stop rubber ring 16 is in sealing fit with an inner wall of the axial cavity 24. A liquid wax outlet end of the liquid collection tank 7 is in fluid communication with a liquid wax inlet end of the filtering equipment of the liquid wax reclaiming mechanism. The liquid wax produced in the cavity of the investment casting shell 14 flows into the wax droplet converging tank 25 of the liquid collection tank 7 under gravity. A wax discharge hole 18 is arranged at a bottom of the wax droplet converging tank 25. The liquid collection tank 7 is fixedly installed on the bearing platform 13.

The first-stage filter screen 8 is fixedly installed at a top of the filter screen bracket 10, and the second-stage filter screen 9 is fixedly installed at a bottom of the filter screen bracket 10. The filter screen bracket 10 is installed at an upper part of the wax storage barrel 11 in a movably embedded manner. The wax storage barrel 11 is installed in heating medium of the oil bath 12, and a thermal insulation cover 20 is arranged on the wax storage barrel 11. When the liquid wax stored in the liquid storage barrel reaches a specified capacity, the filtering equipment is removed, and then the thermal insulation cover 20 covers the wax storage barrel 11 and achieve heat insulation of the reclaimed liquid wax. A lifting ring for manual or mechanical opening and closing of the thermal insulation cover is arranged on the thermal insulation cover 20. A liquid wax inlet end of the first-stage filter screen 8 is in fluid communication with a liquid wax outlet end of the liquid collection tank 7 via a through hole, a liquid wax outlet end of the first-stage filter screen 8 is in fluid communication with a liquid wax inlet end of the second-stage filter screen 9, and a liquid wax outlet end of the second-stage filter screen 9 is in fluid communication with a liquid wax inlet end of the wax storage barrel 11.

In this embodiment, a PID (proportion integration differentiation) controller capable of regulating airflow temperature at the outlet is arranged in the hot air blower. A gas conveying pressure in the pipeline is regulated by the gas pressure regulator 2. Through different combinations of parameters such as airflow temperature, pressure, as well as size and shape of the spray head, and matching with the attitude adjustment and movement of the spray head, the precise control of asynchronous melting loss rate of different micro-regions of the wax mold is achieved, and then the expansion stress control of the wax mold is achieved, thus achieving the purpose of inhibiting the cracking tendency of the mold shell while dewaxing.

In this embodiment, power of the hot air blower is 180 W, the hot air blower is controlled by PID, and its power supply is AC 220 and 50 Hz. The temperature is adjustable, the temperature at an air outlet is 0~300° C., with an accuracy of +/−1° C. The air adjustment range is 20~100%, the maximum air volume is 520 $m^3$/h, and the maximum air pressure is 430 Pa. In some other embodiments, the other types of hot air blowers with other power may also be selected for replacement.

The working pressure of the gas pressure regulator is in a range of 0~2.0 MPa, the maximum working temperature is not lower than 200° C., and the indication range of a gas outlet pressure gauge is 0~0.9 MPa. Pipe diameter of each of the hot air inlet end and the hot air outlet end is DN8. The pressure is adjusted by rotating a pressure-regulating nut. The crawler manipulator is a crawler robot chassis, with a Christie suspension system, capable of steering in situ, with running speed of 0-1.4 m/s and maximum load of 80 kg. The manipulator is a vertical multi-joint arm with six degrees of freedom, with maximum load of 10 kg, and maximum stroke as follows: the arm is rotated by +/−180°, swung back and forth by +155° ~-105°, and swung up and down by +150°~−163°, and the wrist is rotated by +/−270°, bent by +/−145° and twisted by +/−360°, and maximum synthetic speed is 13,100 mm/s.

The gas supply pipe 3 is a 304 stainless steel straight pipe with a dimension of Φ20×8×1200 mm, and a single branch has a length of 350~500 mm. In other some embodiments, pressure-resistant straight pipes with other diameters and wall thicknesses or made of other types of materials may also be selected for replacement. The length of the stainless-steel gas supply straight pipe can be adjusted according to a depth of the inner cavity of the mold shell, and the gas supply straight pipe is formed by connecting one or more stainless-steel pipes with the same diameter by threads. The parallel mechanical claw 4 is a four-degree-of-freedom parallel mechanical claw, in particular to an intelligent robot mechanical arm accessory, with model of Robotiq 2F-140, a stroke of 0~140 mm, a clamping force (adjustable) of 10~125 N, a friction gripping load of 5 kg, a closing speed of 20-150 mm/s, and protection grade of IP40. High-temperature-resistant and anti-slip rubber pads are arranged at an inner side of clamping teeth of the parallel mechanical claw. The universal metal pipe 5 is a flexible pressure-resistant universal metal pipe, which is a DN8 gooseneck pipe, made of 304 stainless steel, with a length of 300~400 mm and a pressure-resistant capacity of not less than 0.7 MPa, and can be connected by a single pipe or multiple pipes with the same diameter via threads, as required.

The rotary spray head 6 is a 360-degree automatic rotary porous spray head, which passes through the axial cavity of the liquid collection tank and can gradually rise along the axis and penetrate into the cavity of the mold shell. The rotary spray head is a fan-shaped spray head or a conical porous spray head. In this embodiment, the spray head able to rotate for 360 degree is made from stainless-steel, a pipe of the airflow inlet with a diameter of DN8, and the spray head is connected via external threads. The spray head rotates automatically, and the spray coverage of three powerful fan-shaped spray heads is 360°, and a slit width of the spray head is 1.2 mm. A spray head support bearing is a hard stainless-steel bearing; the working pressure of the spray head is less than $1.2\times10^6$ Pa. In some other embodiments, the spray heads with other cross-sectional shapes and any number of spray heads with any other slit width may also be used for replacement. An included angle between the spray heads or an included angle between working areas may also be any other angle. In this embodiment, the spray head is of a cylinder with a height of 87 mm, and in other embodiments, spray heads with the shape of truncated cone, cube, cuboid, polyhedral prism and other shapes composed of truncated cone, cube, cylinder, cuboid, and polyhedral prism may also be used. The airflow temperature at the spray head port is controlled at 120~170° C. In some other embodiments, the airflow temperature at the spray head port may also be adjusted in other temperature ranges according to the shell-making process of the mold shell and the structural characteristics of the inner cavity of the mold shell.

Figure 2A:
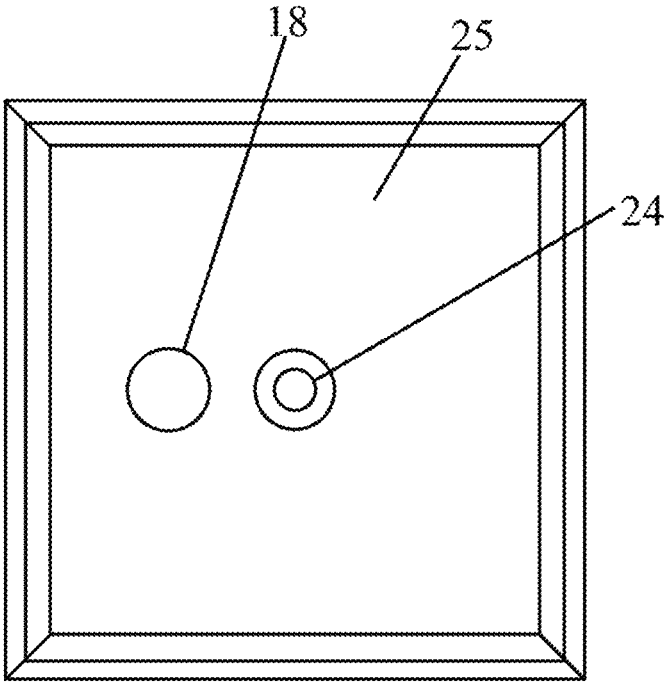
FIG. 2A is a schematic top view of a structure of a quadrangular frustum-shaped liquid collection tank according to an embodiment of the present disclosure.
Figure 2B:
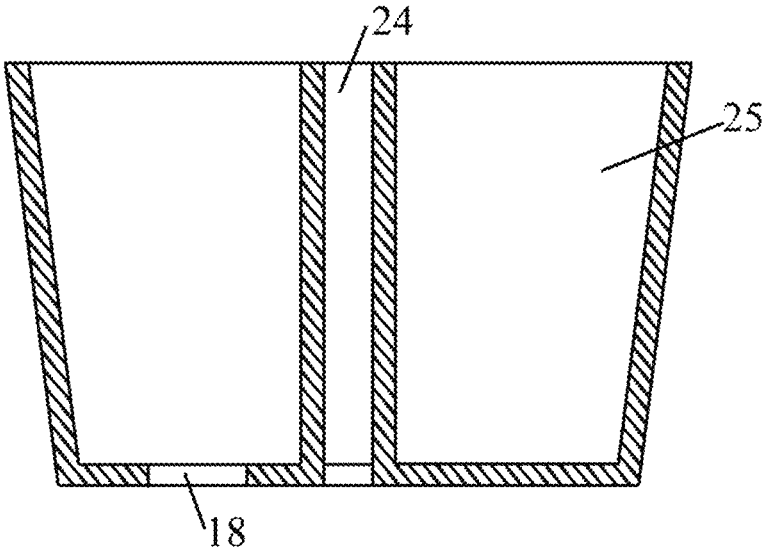
FIG. 2B is a schematic sectional view of a structure of a quadrangular frustum-shaped liquid collection tank according to an embodiment of the present disclosure.
Figure 3A:
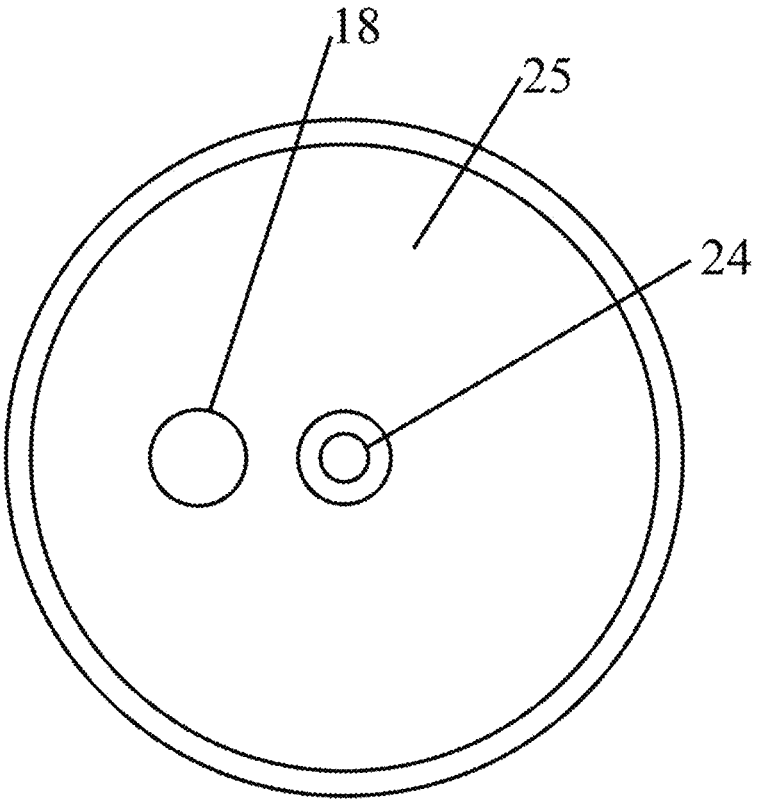
FIG. 3A is a schematic top view of a structure of a circular truncated cone-shaped liquid collection tank according to an embodiment of the present disclosure.
Figure 3B:
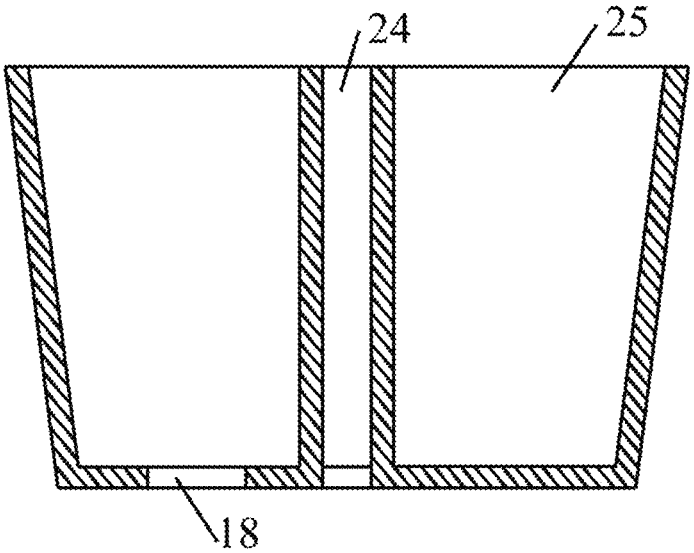
FIG. 3B is a schematic sectional view of a structure of a circular truncated cone-shaped liquid collection tank according to an embodiment of the present disclosure.

The flexible pipe 17 is a high-temperature-resistant and pressure-resistant flexible pipe, specifically a DN8 heat-resistant and pressure-resistant corrugated pipe, made of 304 stainless steel, with a ball joint and threaded connection, and the corrugated pipe can be bent by 360°. The liquid collection tank 7 is an inverted right square frustum, as shown in FIG. 2A and FIG. 2B. In some other embodiments, the liquid collection tank 7 may also be provided as one or combinations of two or more of inverted circular truncated cone, as shown in FIG. 3A and FIG. 3B, trapezoidal frustum, cube or cuboid, and an opening at an upper end of the liquid collection tank 7 is gradually widened to be suitable for pouring cups or wax outlets with different size and shapes, so as to facilitate the collection of liquid wax. An inner diameter of the axial cavity 24 of the liquid collection tank 7 is greater than an outer diameter of the rotary spray head 6, so as to facilitate the moving and passing of the spray head. In this embodiment, a filter medium in the first-stage filter screen 8 is a 60-mesh stainless steel filter screen, and a filter medium in the second-stage filter screen 9 is a 200-mesh stainless steel filter screen. Because particles such as shell-making refractory powder are easily mixed in the melting process of the wax mold, the purpose can be achieved by filtering the medium with a filter screen. As viscosity of the liquid wax is high, when filtering with the quartz powder and other filter media, flow resistance of the liquid wax is high, making it difficult to pass through the filter medium. The oil bath 12 is a high-temperature circulating constant-temperature oil bath.

In this embodiment, a process for hot air jet dewaxing and reclaiming wax composition from pattern for investment casting shell making is as follows:

Step A. According to dewaxing process requirements determined by a material and structure of the wax mold for investment casting shell making, temperature and jet pressure of hot air are adjusted through the a hot air supply mechanism.

Step B. According to the dewaxing process requirements determined by the material and structure of the wax mold for the investment casting shell making, jet direction and jet pressure of hot air are adjusted through the hot air jet dewaxing mechanism to drive the hot air outlet end of the hot air jet dewaxing mechanism to rotate in different rotation rates, so as to control asynchronous melting rate of different micro-regions of the wax mold in the investment casting shell, and making different regions of the wax mold melted asynchronously.

Step C. Liquid wax obtained by melting in Step B is collected through the liquid wax collection mechanism.

Step D. The liquid wax collected in Step C is filtered, heated, and recycled through the liquid wax reclaiming mechanism.

The specific process is as follows: the investment casting shell is fixed to the bearing platform 13, the hot air blower 1 is started to regulate the temperature of hot air of the hot air blower, and regulate the pressure-regulating valve 19 to control the jet pressure of the hot air. The hot air enters the gas supply pipe 3 through the flexible pipe 17, the attitude adjustment and movement of the gas supply pipe 3 is controlled by the crawler manipulator 15 and the parallel mechanical claw 4, and the gas supply pipe 3 passes through the axial cavity 24 of the liquid collection tank 7, so that the rotary spray head 6 at the end of the universal metal pipe 5 connected to the gas supply pipe 3 extends into the cavity of the investment casting shell. The hot air in the pipeline is sprayed to the wax mold inside the cavity of the investment casting shell by the rotary spray head 6, and the wax mold melts to form liquid wax under the heating of the hot air. As the one-way flow-stop rubber ring 16 is installed on the outer pipe wall of the gas supply pipe 3, the liquid wax cannot leak through the axial cavity 24, but can only flow into the wax droplet collection tank 25 under gravity and then be directly discharged from the wax discharge hole 18 at the bottom of the wax droplet converging tank 25 [the wax discharge hole 18 is of an open and straight pipe structure and is not closed; the wax mold, after being heated and melted, drops into the wax droplet converging tank; the liquid wax, after gathering, quickly flows out directly from the wax outlet at the bottom of the converging tank without delay, thus preventing the increase of viscosity, the reduction of flowability, and the inability to flow due to the cooling of the liquid wax. The liquid wax flows to the first-stage filter screen 8, filtered by the first-stage filter screen 8, and continues to flow to the second-stage filter screen 9, filtered by the second-stage filter screen 9, and then flows to the wax storage barrel 11. The liquid wax in the wax storage barrel 11 is heat and kept warm at the oil bath, so as to achieve the purpose of reclaiming the liquid wax. When the temperature of the reclaimed liquid wax meets the requirements for mold-making, the reclaimed liquid wax can be directly used for wax mold manufacturing.

In this embodiment, the device for hot air jet dewaxing and reclaiming wax composition from pattern for investment casting shell making is simple in structure, the hot airflow dewaxing treatment process is carried out under normal temperature and pressure environment, water is not contained in the heat transfer medium, the liquid wax does not need dehydration treatment, and the liquid wax can be directly reused only by simple filtration to remove a small amount of particle impurities, thus achieving full regeneration. During dewaxing treatment, the wax mold has small thermal shock area, small heat affected zone, and low expansion stress. The impact of the hot air leads to dehydration and hardening of a region, which is partially hardened, of an inner surface of the mold shell, the wet strength of the mold shell is significantly improved, and thus the cracking tendency of the mold shell during baking can be effectively inhibited. During actual operation, according to the structural characteristics of the inner cavity of the mold shell, phased, multi-frequency, non-uniform pressure regulation and airflow temperature regulation can be employed to optimize the dewaxing rate. When the device of this embodiment is used for dewaxing, the load of water in the reclaimed liquid wax and the formation of saponification products can be effectively avoided, and the quality of the reclaimed liquid wax is good, and the environmental load is low. The process of dewaxing and reclaiming the liquid wax by this device is simple, rapid, efficient, low in cost and wide in adaptability, which can effectively solve the problems of easy deformation and damage of the mold shell during the dewaxing of the investment casting shell, high energy consumption and low efficiency in dehydration and acid treatment process, complicated process and environmental pollution caused by waste liquid treatment, and zero emission and clean production can be achieved.

Apparently, above embodiments are only examples for clear explanation, rather than limiting the implementations. For those skilled in the art, other changes or variations in different forms may be made on the basis of the above description. It is not necessary and impossible to exhaust all the implementations here. However, the obvious changes or variations derived therefrom are still within the scope of protection claimed by the present disclosure.

What is claimed is:

1. A device for hot air jet dewaxing and reclaiming wax composition from a pattern for investment casting shell making, the device comprising:

a hot air supply mechanism;

a hot air jet dewaxing mechanism;

a liquid wax collection mechanism;

a liquid wax reclaiming mechanism; and a bearing platform, wherein an investment casting shell is fixedly installed on the bearing platform, a hot air outlet end of the hot air supply mechanism being in fluid communication with a hot air inlet end of the hot air jet dewaxing mechanism, a hot air outlet end of the hot air jet dewaxing mechanism extending into a cavity of the investment casting shell and facing a wax mold;

wherein the hot air has a temperature within a range of 120 to 170° C.;

wherein liquid wax generated in the cavity of the investment casting shell is configured to flow into a liquid wax inlet end of the liquid wax collection mechanism under gravity, and wherein a liquid wax outlet end of the liquid wax collection mechanism is in fluid communication with a liquid wax inlet end of the liquid wax reclaiming mechanism.

2. The device for hot air jet dewaxing and reclaiming wax composition from pattern for investment casting shell making according to claim 1, wherein the hot air supply mechanism comprises a hot air blower, and a gas pressure regulator; a hot air outlet end of the hot air blower is in fluid communication with a hot air inlet end of the gas pressure regulator; a pressure-regulating valve on the gas pressure regulator is controlled to adjust jet pressure of the hot air blower; and a hot air outlet end of the gas pressure regulator is in fluid communication with a hot air inlet end of the hot air jet dewaxing mechanism.

3. The device for hot air jet dewaxing and reclaiming wax composition from pattern for investment casting shell making according to claim 1, wherein the hot air jet dewaxing mechanism comprises a gas supply pipe, a parallel mechanical claw, a universal metal pipe, a rotary spray head, and a crawler manipulator; the parallel mechanical claw is installed on the crawler manipulator, and an outer pipe wall of the gas supply pipe is clamped on the parallel mechanical claw by clamping parts of the parallel mechanical claw; the universal metal pipe is fixedly connected to the gas supply pipe, and the rotary spray head is fixedly installed at one end of the universal metal pipe; a hot air outlet end of the gas supply pipe is in fluid communication with a hot air inlet end of the universal metal pipe, and a hot air outlet end of the universal metal pipe is in fluid communication with a hot air inlet end of the rotary spray head; a hot air outlet end of the rotary spray head extends into the cavity of the investment casting shell and faces the wax mold; and a hot air inlet end of the gas supply pipe is in fluid communication with the hot air outlet end of the hot air supply mechanism through a flexible pipe.

4. The hot air jet dewaxing and reclaiming wax composition from pattern for investment casting shell making according to claim 3, wherein the gas supply pipe is a stainless steel straight pipe; the parallel mechanical claw is a four-degree-of-freedom parallel mechanical claw; the universal metal pipe is a flexible and pressure-resistant universal metal pipe with a withstand pressure not less than 0.7 MPa; the rotary spray head is a 360-degree automatic rotary porous spray head; and the flexible pipe is a high-temperature-resistant and pressure-resistant flexible pipe made of 304 stainless steel.

5. The hot air jet dewaxing and reclaiming wax composition from pattern for investment casting shell making according to claim 3, wherein the liquid wax collection mechanism is a liquid collection tank, the liquid collection tank comprises a wax droplet converging tank and an axial cavity, and the wax droplet converging tank and the axial cavity are two mutually independent spaces; the rotary spray head and the universal metal pipe sequentially penetrate through the axial cavity and extend into the cavity of the investment casting shell, the gas supply pipe extends into the axial cavity, a one-way flow-stop rubber ring is sleeved on the outer pipe wall of the gas supply pipe, and the one-way flow-stop rubber ring is in sealing fit with an inner wall of the axial cavity; a liquid wax outlet end of the liquid collection tank is in fluid communication with the liquid wax inlet end of the liquid wax reclaiming mechanism; the liquid wax produced in the cavity of the investment casting shell flows into the wax droplet converging tank of the liquid collection tank under gravity; and the liquid collection tank is fixedly installed on the bearing platform.

6. The hot air jet dewaxing and reclaiming wax composition from pattern for investment casting shell making according to claim 5, wherein the liquid collection tank is one or a combination of two or more of regular quadrangular frustum, inverted circular truncated cone, trapezoidal frustum, cube or cuboid; a wax discharge hole is arranged at a bottom of the wax droplet converging tank.

7. The hot air jet dewaxing and reclaiming wax composition from pattern for investment casting shell making according to claim 1, wherein the liquid wax reclaiming mechanism comprises filtering equipment, a wax storage barrel, and an oil bath; the filtering equipment is installed at an upper part of the wax storage barrel, and the wax storage barrel is installed in a heating medium of the oil bath; a liquid wax outlet end of the filtering equipment is in fluid communication with a liquid wax inlet end of the wax storage barrel, and a liquid wax inlet end of the filtering equipment is in fluid communication with the liquid wax outlet end of the liquid wax collection mechanism;

a thermal insulation cover is further arranged on the wax storage barrel; when the liquid wax stored in the wax storage barrel reaches a specified capacity, the filtering equipment is removed, and then the thermal insulation cover is closed to cover the wax storage barrel; and a lifting ring is arranged on the thermal insulation cover.

8. The hot air jet dewaxing and reclaiming wax composition from pattern for investment casting shell making according to claim 7, wherein the filtering equipment comprises a first-stage filter screen, a second-stage filter screen, and a filter screen bracket; the first-stage filter screen is fixedly installed at a top of the filter screen bracket, and the second-stage filter screen is fixedly installed at a bottom of the filter screen bracket; the filter screen bracket is installed on the upper part of the wax storage barrel in a movably embedded manner; a liquid wax outlet end of the first-stage filter screen is in fluid communication with a liquid wax inlet end of the second-stage filter screen, and a liquid wax outlet end of the second-stage filter screen is in fluid communication with the liquid wax inlet end of the wax storage barrel; and a liquid wax inlet end of the first-stage filter screen is in fluid communication with the liquid wax outlet end of the liquid wax collection mechanism via a through hole.

9. The hot air jet dewaxing and reclaiming wax composition from pattern for investment casting shell making according to claim 8, wherein a filter medium in the first-stage filter screen is a 60-mesh stainless steel filter screen, and a filter medium in the second-stage filter screen is a 200-mesh stainless steel filter screen.

10. A process for hot air jet dewaxing and reclaiming wax composition from pattern for investment casting shell making, wherein the device for hot air jet dewaxing and reclaiming wax composition from pattern for investment casting shell making according to claim 1 is used for the hot air jet dewaxing and reclaiming wax composition from pattern for investment casting shell making, the process comprising the following steps:

Step A: according to dewaxing process requirements determined by material and structure of the wax mold for investment casting shell making, adjusting temperature and jet pressure of hot air through the hot air supply mechanism;

Step B: according to the dewaxing process requirements determined by the material and structure of the wax mold for investment casting shell making, adjusting jet direction and the jet pressure of the hot air through the hot air jet dewaxing mechanism to drive the hot air outlet end of the hot air jet dewaxing mechanism to rotate in different rotation rates, so as to control asynchronous melting loss rate of different micro-regions of the wax mold in the investment casting shell, and make different regions of the wax mold melted asynchronously;

Step C: collecting liquid wax obtained by melting in Step B through the liquid wax collection mechanism; and Step D: filtering, heating, and recycling the liquid wax collected in Step C through the liquid wax reclaiming mechanism.

* * * * *